US007484251B2

(12) United States Patent
Huang

(10) Patent No.: US 7,484,251 B2
(45) Date of Patent: Feb. 3, 2009

(54) LAVATORY JET ASSEMBLY

(76) Inventor: Lin Yi Huang, 10750 Viking Ave., Northridge, CA (US) 91326

( * ) Notice: Subject to any disclaimer, the term of this patent is extended or adjusted under 35 U.S.C. 154(b) by 392 days.

(21) Appl. No.: 11/098,817

(22) Filed: Apr. 4, 2005

(65) Prior Publication Data

US 2005/0257316 A1 Nov. 24, 2005

(30) Foreign Application Priority Data

May 18, 2004 (TW) ..... 93207806 U
May 18, 2004 (TW) ..... 93207807 U

(51) Int. Cl.
*A47K 3/20* (2006.01)

(52) U.S. Cl. ..... 4/420.4; 4/420.1; 4/443; 4/448

(58) Field of Classification Search ..... 4/420.1–520.5
See application file for complete search history.

(56) References Cited

U.S. PATENT DOCUMENTS 4,564,961 A * 1/1986 Kaneko et al. ..... 4/443
4,570,274 A * 2/1986 Kaneko et al. ..... 4/443
4,704,748 A * 11/1987 Takeda et al. ..... 4/420.4
4,933,997 A * 6/1990 Kaneko ..... 4/420.4
5,025,511 A * 6/1991 Takeda et al. ..... 4/447
6,769,140 B1 * 8/2004 Olivier ..... 4/420.4
6,959,459 B2 * 11/2005 Takenaga ..... 4/420.4

* cited by examiner

*Primary Examiner*—Khoa D Huynh
(74) *Attorney, Agent, or Firm*—Raymond Y. Chan; David and Raymond Patent Firm

(57) ABSTRACT

A lavatory jet assembly for a lavatory having an upper rim and defining a top opening therewithin, comprising a mounting base, jet unit and jet adjusting arrangement, such that the lavatory jet assembly allows a user to choose, after urination or defecation, from the buttons on a control stand to control the jet flowing time and the protruding length of the jet, to control the movement of the driving shaft which is connected to a servo motor or the stepping motor, and simultaneously control the jet which is installed to a side to move to the desired position, so as to automatically washes the excretion organ area of the user.

13 Claims, 11 Drawing Sheets

LAVATORY JET ASSEMBLY

BACKGROUND OF THE PRESENT INVENTION

1. Field of Invention

The present invention relates to a lavatory jet assembly, and more particularly to a lavatory jet assembly which is assembled at the rear of the lavatory seat, so as to allow a user to choose, after urination or defecation, from the buttons on a control stand to control the jet flowing time and the protruding length of the jet, to control the movement of the driving shaft which is connected to a servo motor or the stepping motor, and simultaneously control the jet which is installed to a side to move to the desired position, so as to automatically washes the excretion organ area of the user.

Alternatively, the driving shaft is replaced by a belt gear which is connected to the servo motor or the stepping motor, such that the buttons on the control stand controls the movement of the belt gear, and simultaneously control the jet which is installed to a side to move to the desired position, so as to automatically washes the excretion organ area of the user.

2. Description of Related Arts

Although conventional lavatory jet assemblies differ from one another, they are basically adjusted through the control of the jet assembly, so as to align with the user's excretion organ area and automatically release a water jet for cleaning the user's excretion organ area.

A Taiwanese patent, publication number 249445 and published on Jun. 11, 1995, discloses an automatic water jet which structure is that a motor 2 installed on the body, wherein the motor provides movement to a pair of gear 41, 41' having a transmission belt 4,such that the kinetic energy is transferred to a stabilizing rod 32 which has a jet opening 3, wherein the stabilizing rod 32 is provided for linking up with a water rod 31 which links to an external water source, wherein the jet opening 3 is provided for cleaning the user's excretion organ and is provided on the water rod 31.

Another Taiwanese patent, publication number 291012 and published on Nov. 11, 1996, discloses a jet assembly that a water rod 5, wherein a padding W and spring 4 is inserted therein, is inserted into the main axle 3. An O-shaped ring 0 is being inserted at an end of the water inlet 6, so as to block a water entering end at the main axle 3 of the water inlet 6. The motor is installed on an exterior of the body 1 and the motor's axle is connected to the gear 8 in the body 1. The body 1 is electrically connected to a micro-switch 91 on a circuit board 9. Furthermore, the main axle 3 is inserted into the body 1, wherein a slanted groove is provided for the gear teeth on the main axle to mesh with the gear 8. At last, the back stand 1 is locked in position with the main body. This type of jet assembly makes use of the kinetic energy of spraying water to push the jet rod 2 from the main axle 3 to a first spraying position, and then makes use of the gear 8 to guide the gear teeth of the main axle to extend in an adjusting microinching manner, so as to achieve a large trajectory and large area water spraying, so as to clean the excretion organ area of the user.

SUMMARY OF THE PRESENT INVENTION

A main object of the present invention is to provide a lavatory jet unit assembly for a lavatory having an upper rim and defining a top opening therewithin, which comprises a mounting base, a jet unit and a jet adjusting arrangement so as to adjust the position and the length of the jet unit, allowing a user to choose the position where the jet unit ejects a flow of water, so as to clean the excretion organ area of the user.

Another object of the present invention is to provide a lavatory jet unit assembly, which has a finer jet unit, such that a user can press on a button positioned at a side of the lavatory which controls the motor that controls the position of the jet unit after urination or defecation, such that the jet unit is guided by the belt gear so as to adjust the desired position in which the jet unit sprays water for the purpose of cleaning the excretion organ area of the user.

Another object of the present invention is to provide a lavatory jet unit assembly, which is located at the rear portion of the lavatory seat, wherein the jet unit assembly comprises a mounting base and a motor provided at an inner end of the mounting base, wherein the axle of the motor connects to a main belt gear.

Another object of the present invention is to provide a lavatory jet unit assembly, wherein a driven belt gear is installed on an outer end of the mounting base, wherein a transmission belt is wound around the main belt gear and the driven belt gear. At a predetermined position of the transmission belt is the connecting portion of the jet unit, wherein the connecting portion of the jet unit protrudes from the water inlet, wherein the connecting portion of the jet unit is located at the front connecting portion of the jet unit, and the jet unit is installed at a side of the mounting base in an adjustable manner, such that the connecting portion of the jet unit is integrally formed on the mounting base.

Another object of the present invention is to provide a lavatory jet unit assembly, wherein the center of gravity of the jet unit is stably protruding from a corresponding position fixing hole on the corresponding area of the stand of the mounting base, wherein when the assembled jet unit assembly is driven by the motor the belt gear is also driven, such that through a movement of an end of the water inlet which is connected to the transmission belt, the position of the jet unit is being adjusted, so as to achieve the objective of cleaning different users' excretion organ areas.

Another object of the present invention is to provide a lavatory jet unit assembly, which has a finer jet unit, such that a user can press on a button positioned at a side of the lavatory which controls the motor that controls the position of the jet unit after urination or defecation, such that the jet unit is adjusted by a driving shaft to the desired position of the jet unit in which the jet unit sprays water for the purpose of cleaning the excretion organ area of the user.

Another object of the present invention is to provide a lavatory jet unit assembly, wherein the axle of the motor connects to an inner end the driving shaft, such that the movement of the driving shaft is provided by the motor, such that the position of the jet unit is adjusted by the movement of the driving shaft, such that the jet unit reaches a desired position to wash the excretion organ area of the user.

Another object of the present invention is to provide a lavatory jet unit assembly, wherein an outer end of the driving shaft is connected to a stand of the mounting base which extends from a corresponding position of the mounting base, wherein in between the mounting base and the stand of the mounting base is a duct tract which is provided for aligning in a matching manner with the secondary supporting stand, which is formed on the side of the water inlet, which is connected to an end portion of the jet unit, which is provided on the hole of the stand of the mounting base, which is downwardly facing, to further stabilize the jet unit.

Another object of the present invention is to provide a lavatory jet unit assembly, wherein a protruding portion is formed when a guiding portion facing the driving shaft is extended from an end of the water inlet, wherein the protruding portion is capable of being inserted into a spiral groove correspondingly.

Another object of the present invention is to provide a lavatory jet unit assembly, wherein when the jet unit assembly formed is driven by the motor, the driving shaft is also being driven, such that the position of the driving shaft is altered according to the protruding portion of the spiral groove of the water inlet, so as to adjust the position of the jet unit assembly, so as to accordingly providing cleaning action to users.

Accordingly, in order to accomplish the above objects, the present invention provides a lavatory jet assembly for a lavatory having an upper rim and defining a top opening therewithin, comprising:

a mounting base, which is adapted for securely mounting to the lavatory, having an inner end positioning closed to the upper rim of the lavatory and an outer end extended towards a center of the top opening;

a jet unit comprising a water inlet for guiding a predetermined volume of water flowing from the lavatory, and a jet nozzle communicatively connecting to the water inlet for upwardly ejecting the water therefrom towards the top opening of the lavatory; and a jet adjusting arrangement comprises a power unit supported by the mounting base and an adjustment slider powered by the power unit to adjustably move the jet nozzle along the mounting base between the inner and outer ends thereof such that the jet nozzle is selectively moved to a desired cleaning position for ejecting the water within the upper rim of the lavatory.

These and other objectives, features, and advantages of the present invention will become apparent from the following detailed description, the accompanying drawings, and the appended claims.

DETAILED DESCRIPTION OF THE PREFERRED EMBODIMENT

Figure 1:
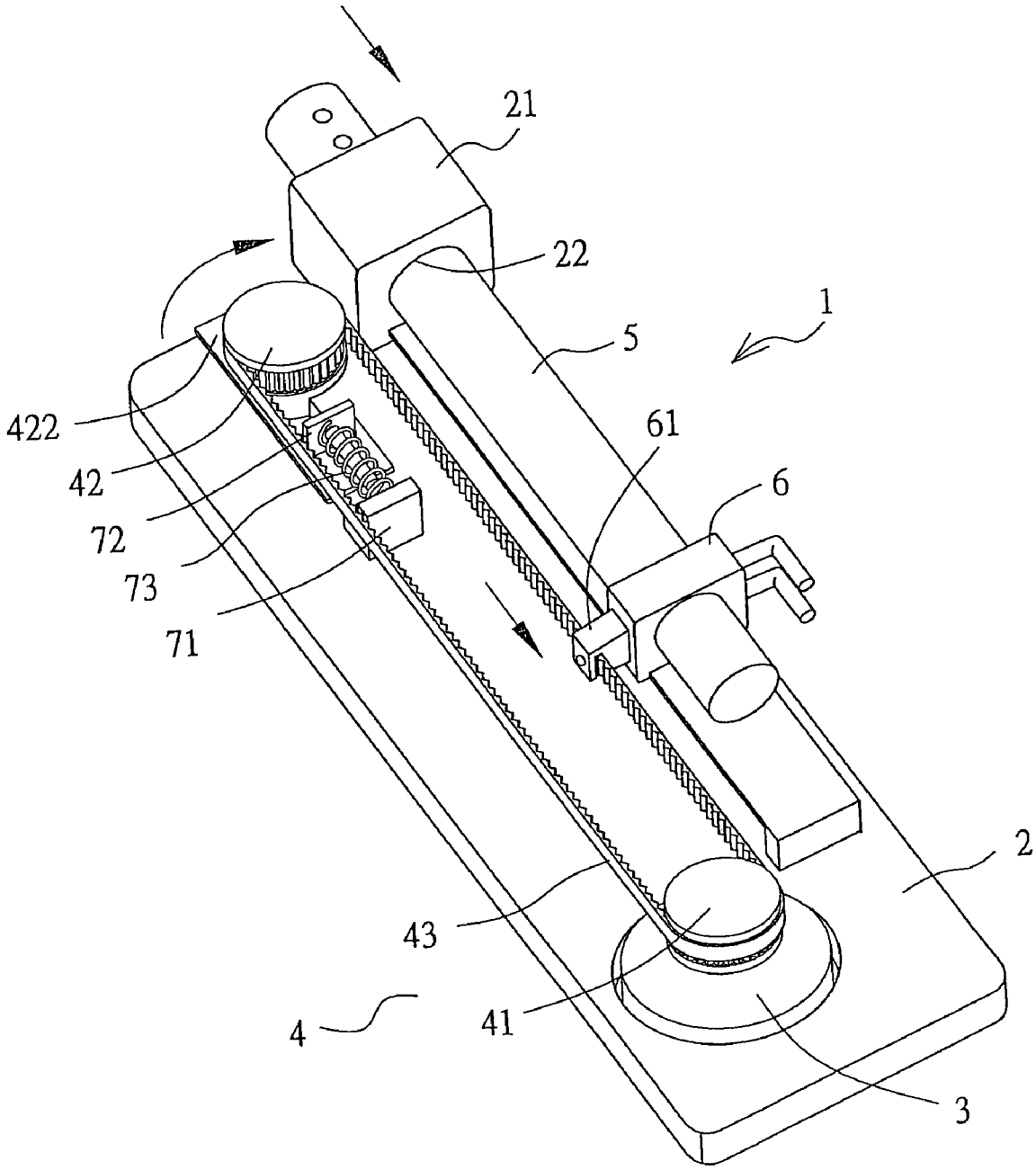
FIG. 1 is a perspective view of a lavatory jet assembly according a first embodiment of the present invention.

Referring to FIG. 1 of the drawings, a lavatory jet assembly for a lavatory (toilet bowl) connected to a water source for flushing the lavatory and having an upper rim and defining a top opening therewithin according to the preferred embodiment of the present invention is illustrated, wherein the lavatory jet assembly comprises a jet unit assembly 1 installed at the rear portion of a lavatory seat of a lavatory, wherein the jet unit assembly 1 has a mounting base 2.

At an inner end of the mounting base 2, a power unit having a motor 3 which is connected to a power source is installed thereon, wherein an axle 31 of the motor 3 is connected to a main belt gear 41. A driven belt gear 42 is installed at an outer end of the mounting base. A transmission belt 43 is placed around the main belt gear 41 and the driven belt gear 42, such that the transmission belt 43 essentially ties the main belt gear 41 together with the driven belt gear 42, so as to form a belt gear system 4.

At a predetermined position on the transmission belt 43 is a connecting portion 61 of the jet unit 5 having a water inlet 6 and a jet nozzle, wherein the connecting portion 61 of the jet unit 5 is extended from a water inlet 6, in order to provide a positioning control. The water inlet 6 guides a predetermined volume of water flowing from the lavatory, which is connected to the water source. The jet nozzle is communicatively connected to the water inlet 6. The connecting portion 61 of the jet unit 5 is located at the front portion of the jet unit 5, and the jet unit 5 is installed at a side of the mounting base in an adjustable manner, such that the connecting portion 61 of the water inlet and the jet unit 5 is integrally formed on the mounting base 2.

The water inlet is an elongated water guider having one end defining the water inlet and an opposed end connecting to the jet nozzle.

The center of gravity of the jet unit 5 is stably penetrating from a position fixing hole 22 on a corresponding area of a coupling stand of the mounting base 21. A first contacting portion 72, which is at a predetermined position of the transmission belt 43 that is in close proximity of the driven belt gear 42, extends from a center axel of the driven belt gear 42 towards a second contacting portion 71, wherein a protruding board body 422 of the center axle 421 and a corresponding layer of the mounting base 2 are independent but forms an interconnection with each other. The first and the second contacting portion 71, 72 must be at a predetermined distance apart, allowing a resilient element 73 to be fitted in between the first and second contacting portion 71, 72, so as to maintain the predetermined amount of tension of the belt gear system 4.

Figure 2:
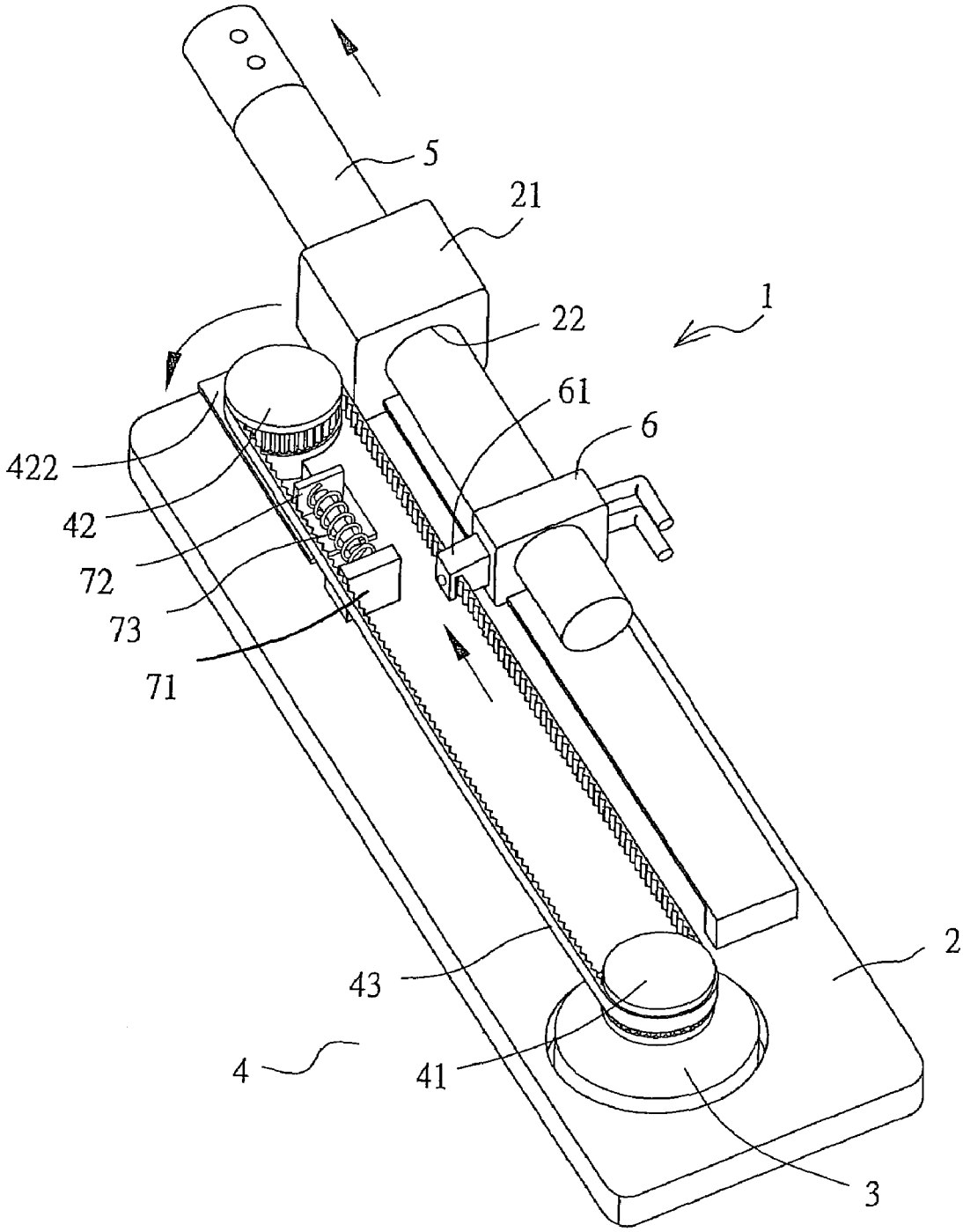
FIG. 2 is another perspective view of the lavatory jet assembly according to the above first embodiment of the present invention.
Figure 3:
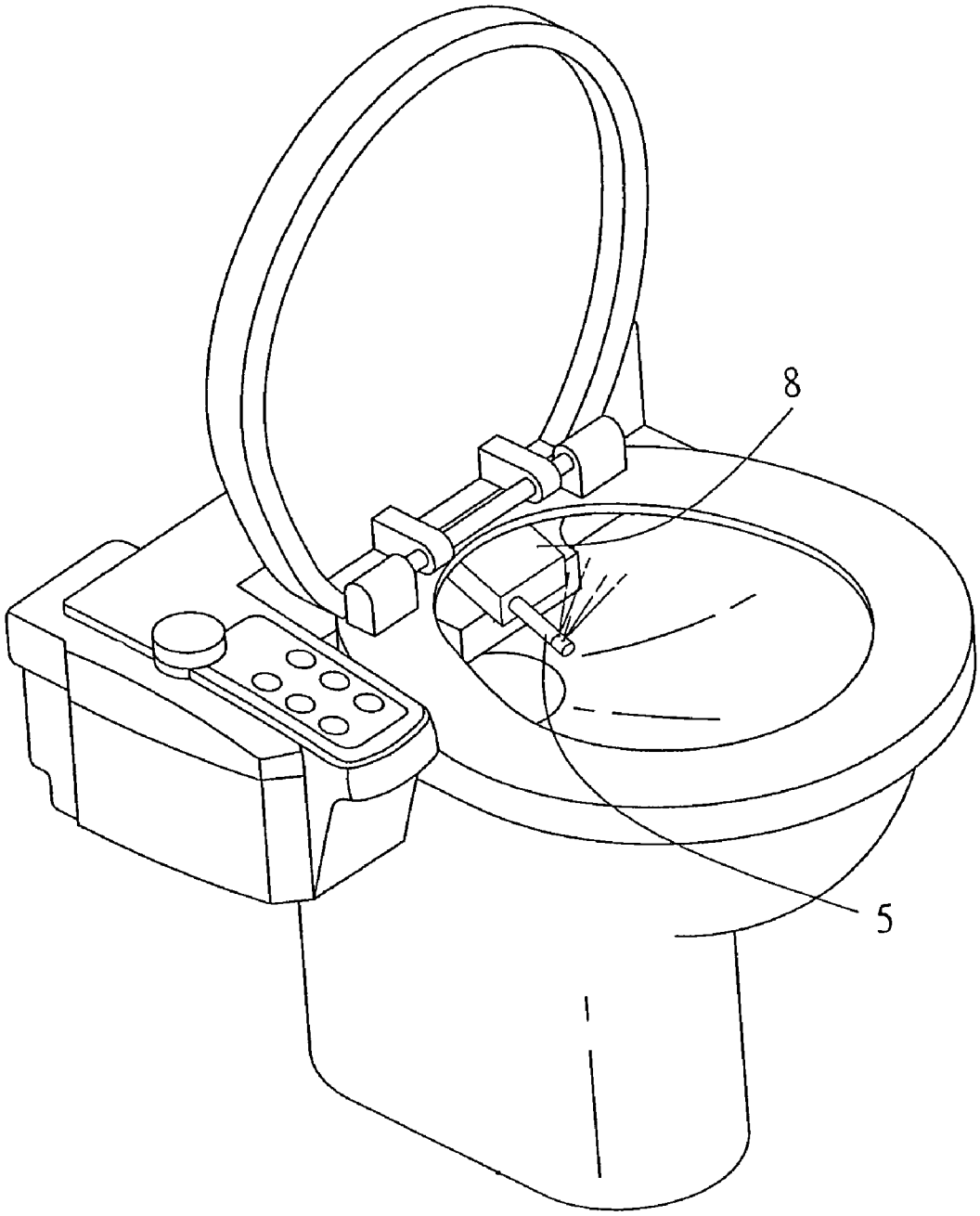
FIG. 3 is a perspective view of the lavatory jet assembly incorporated in a lavatory according to the above first embodiment of the present invention.
Figure 4:
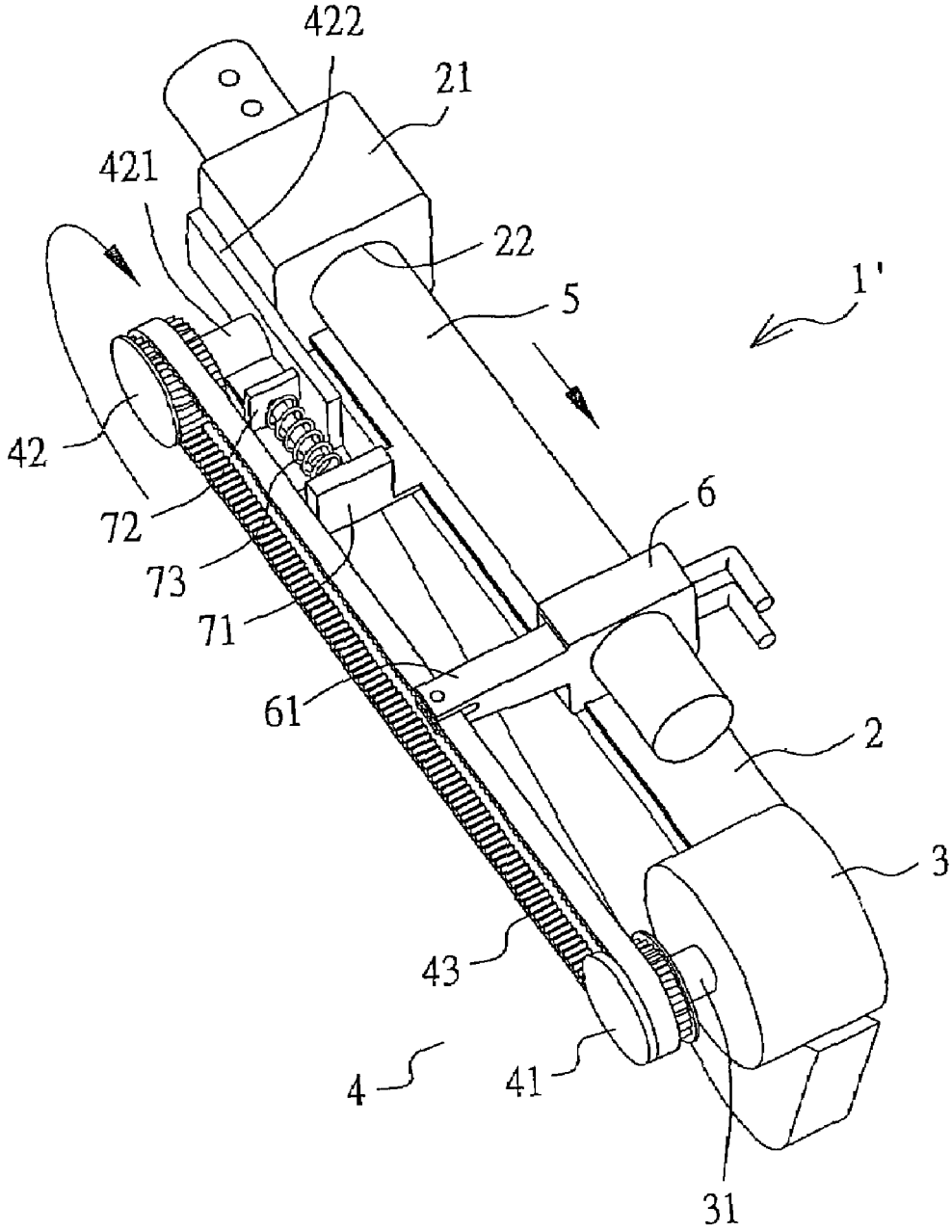
FIG. 4 is a perspective view of the lavatory jet assembly according to an alternative embodiment of the above first embodiment of the present invention.

Referring to FIG. 1, FIG. 4 to FIG. 6, the mounting base 2 and the belt gear system 4 of the jet unit assembly 1' can be downwardly perpendicular, such that the get assembly 1' is formed in a narrower form, wherein the jet unit assembly 1' is essentially the same as that appear in FIG. 1 and FIG. 2.

On a periphery of the jet unit assembly 1 according to this embodiment of the present invention a concealing member 8, wherein an end is installed at the lavatory seat at the rear portion of the lavatory, wherein the jet unit 5 is kept at a predetermined downwardly protruding predetermined angle, such that the jet unit assembly 1 will automatically spray water to clean the user after urination and defecation.

Figure 5:
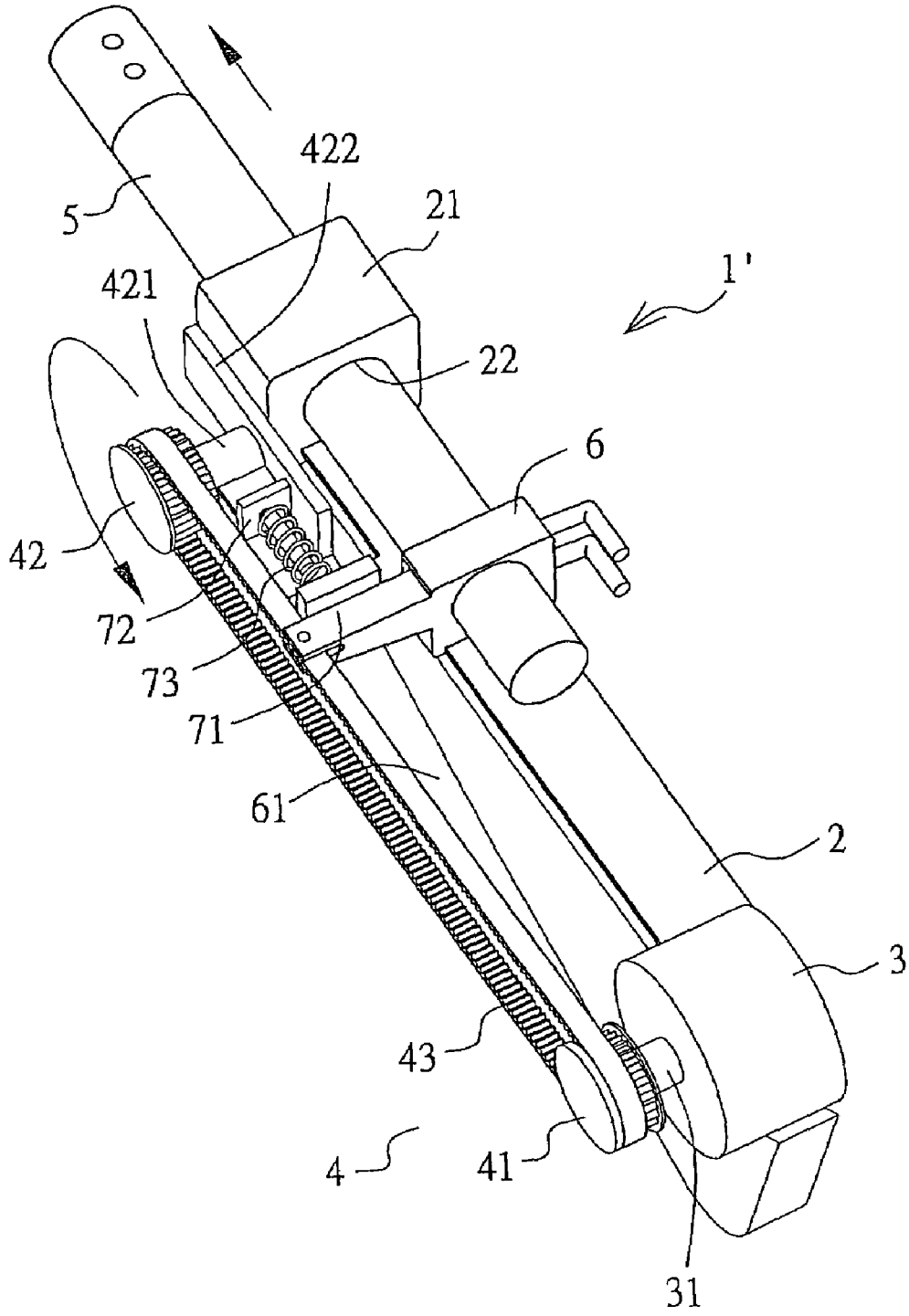
FIG. 5 is another perspective view of the lavatory jet assembly according to the above alternative embodiment of the above first embodiment of the present invention.
Figure 6:
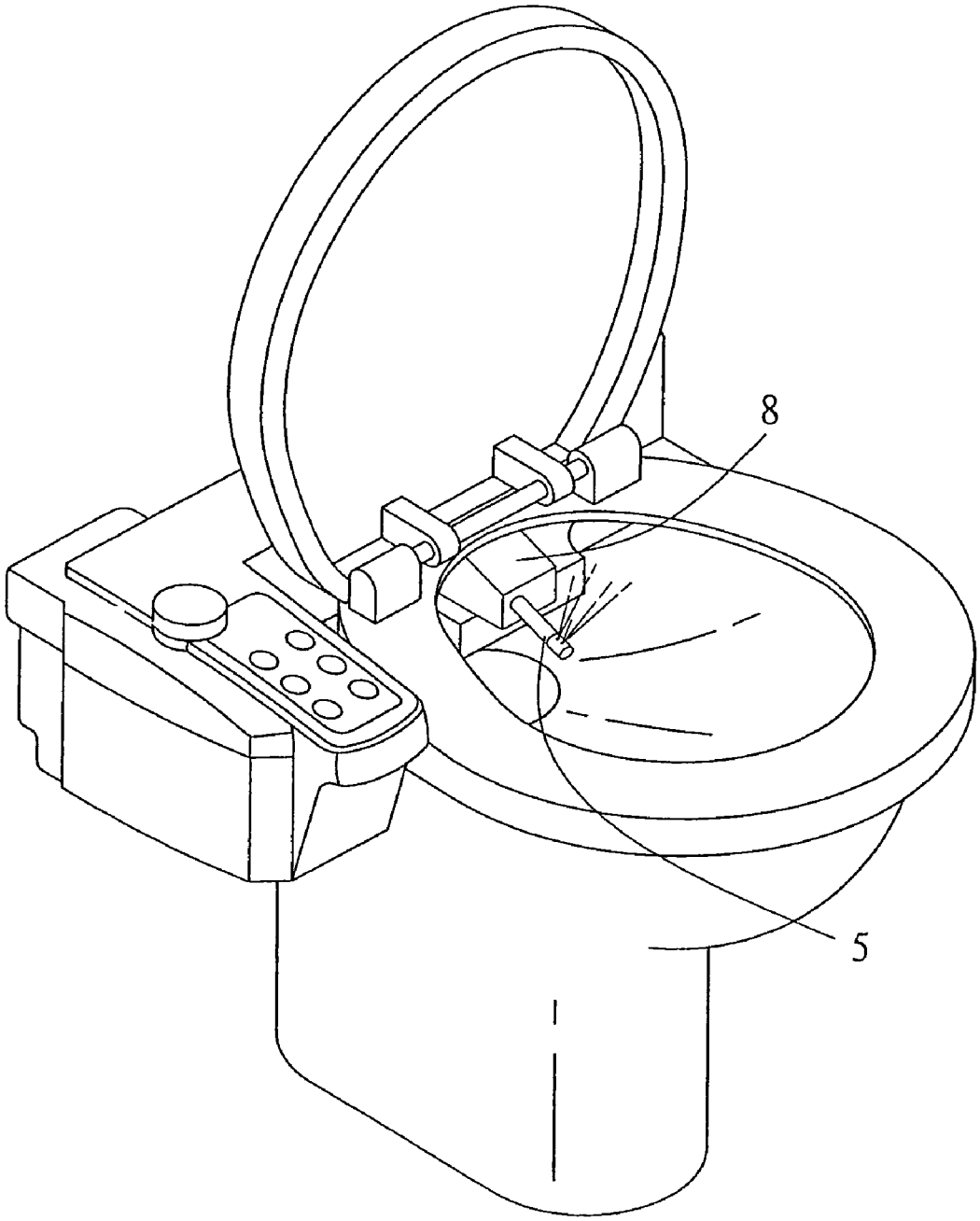
FIG. 6 is a perspective view of the lavatory jet assembly incorporated in a lavatory according to the above alternative embodiment of the above first embodiment of the present invention.

Referring to FIG. 5 of the drawings, the user can choose the spraying time of the jet unit 5 and the protruding length of the jet unit through a control at a side of the lavatory, so as to initiate the motor 3, so as to drive the belt gear system 4, so as to guide the connecting portion 61 of the water inlet 6, which is connected to the side of the transmission belt 43, to move towards a predetermined position, such that the jet unit 5 which is connected to the water inlet 6 is simultaneously adjusted to the desired position, so as to allow different users to control the position of the water spraying.

Figure 7:
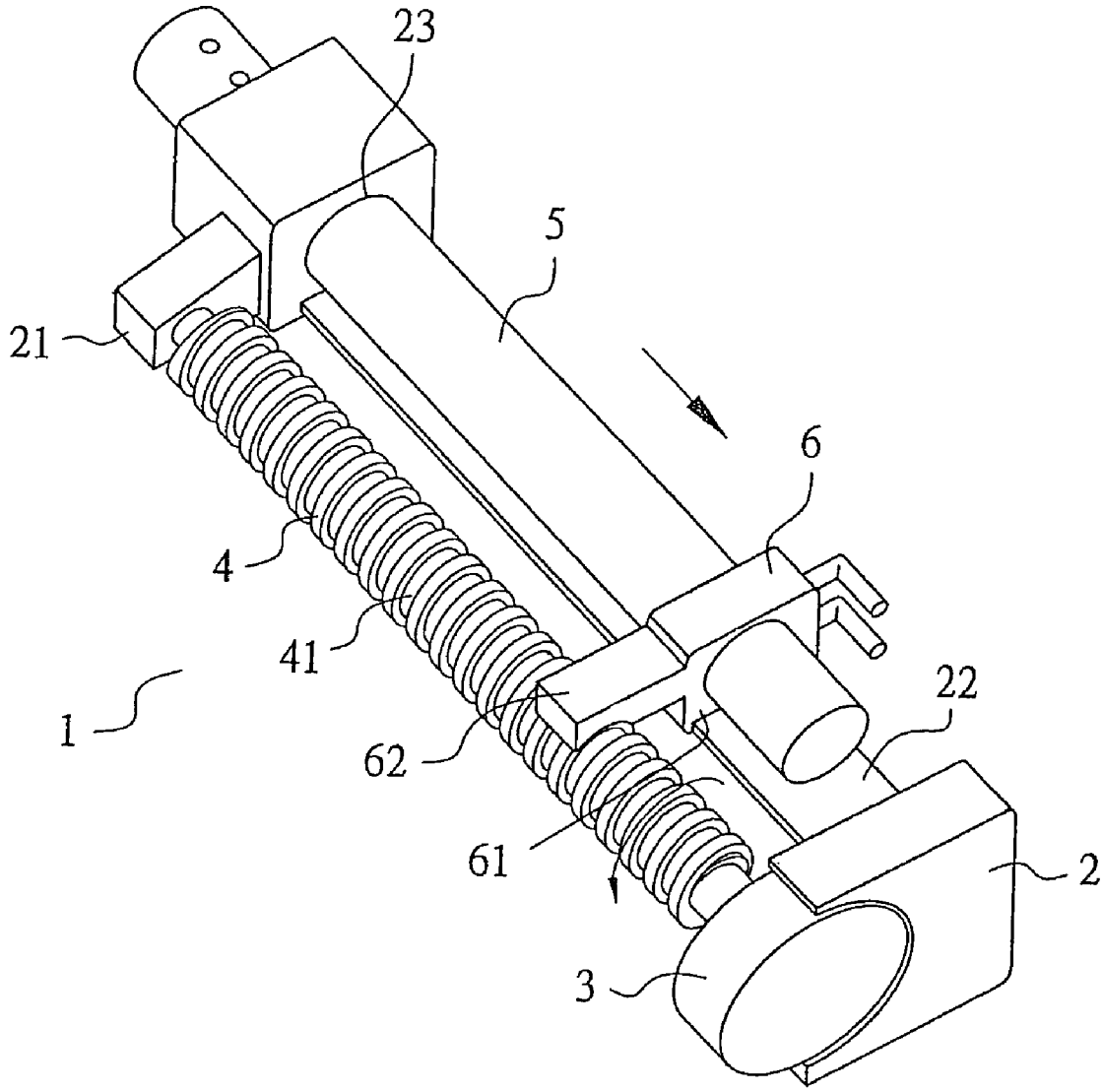
FIG. 7 is a perspective view of a lavatory jet assembly according to a second embodiment of the present invention.

Referring to FIG. 7 of the drawings, a lavatory jet assembly for a lavatory (toilet bowl) connected to a water source for flushing the lavatory and having an upper rim and defining a top opening therewithin according to an alternative embodiment of the present invention is illustrated, wherein the lavatory jet assembly comprises, a lavatory 10 and a jet unit assembly 1 installed at a rear portion of the lavatory seat 20.

The lavatory jet assembly has a power unit having a motor 3 and a power source, wherein the motor 3 is connected to the power. The motor 3 is connected at an inner end of the mounting base 2, wherein an axle of the motor connects to a driving shaft 4 at an inner end. An outer end of the driving shaft 4 is connected to a coupling stand of the mounting base 21, wherein the coupling stand of the mounting base 21 is extended from a corresponding position of the mounting base 2.

In between the mounting base 2 and the coupling stand of the mounting base 21, is a duct tract 22. The duct tract 22 is provided for aligning in a matching manner with the secondary supporting stand 61, which is formed on the side of a water inlet 6, which is connected to an end portion of a jet unit 5, which is provided on the through hole 23 of the coupling stand of the mounting base 21, which is downwardly facing, to further stabilize the jet unit.

Figure 9:
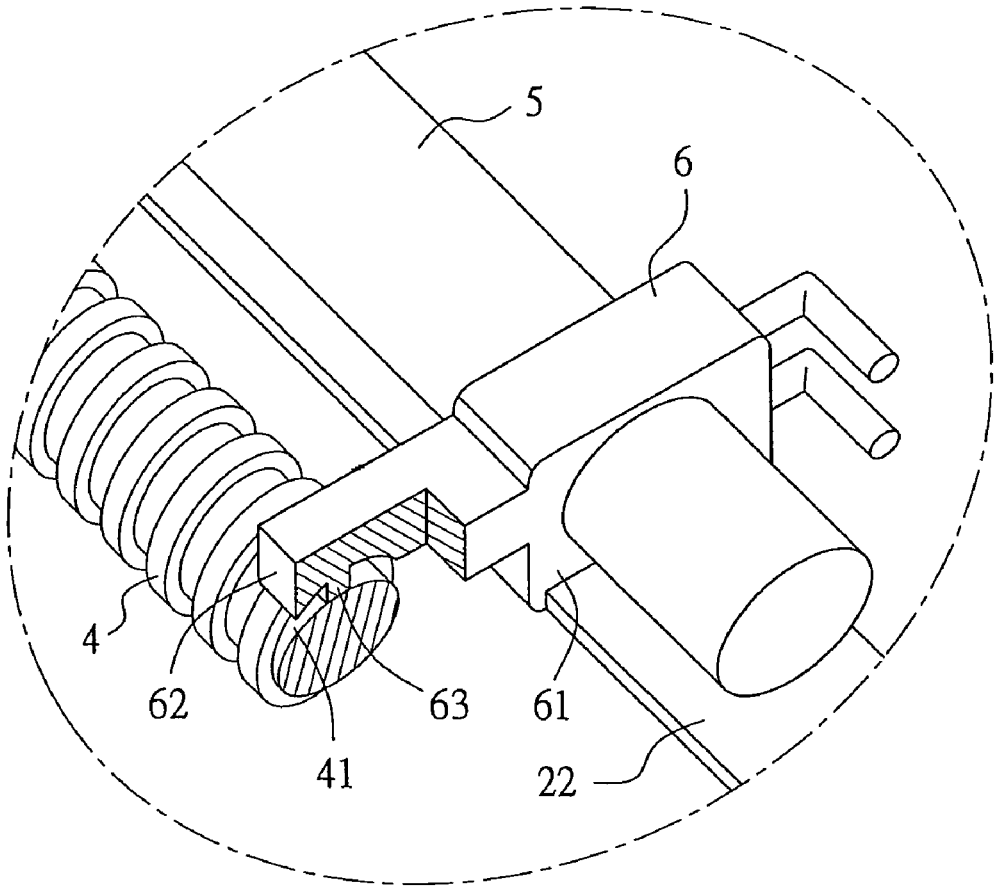
FIG. 9 is an enlarged view of the lavatory jet assembly according to the above second embodiment of the present invention.

Referring to FIG. 9 of the drawings, a protruding portion 63 is formed when a guiding portion 62 facing the driving shaft 4 is extended from an end of the water inlet 6, wherein the protruding portion 63 is capable of being inserted into a spiral groove 41 correspondingly.

Figure 11:
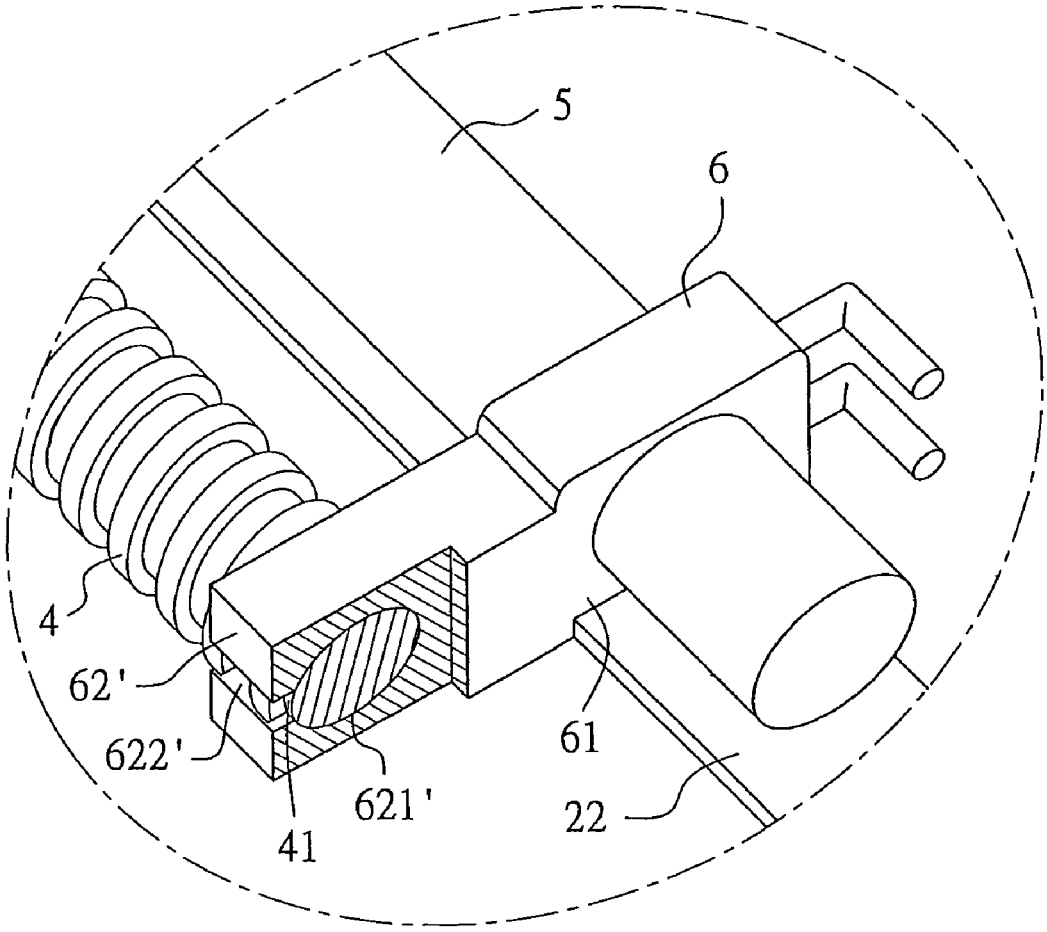
FIG. 11 is an enlarged view of the lavatory jet assembly according to an alternative embodiment of the above second embodiment of the present invention.

Referring to FIG. 11 of the drawings, alternatively, the guiding portion 62' can be in the form of a ring structure or an axle supporting structure, wherein a ring shaped structure of the guiding portion interior 621' has an opening 622', providing more flexibility to the ring shaped structure to withstand expansions and contracts due to temperature changes. The opening 622' also allows efficient and effective cleaning of dirt, dust, and so forth that has accumulated on the driving shaft 4.

Figure 10:
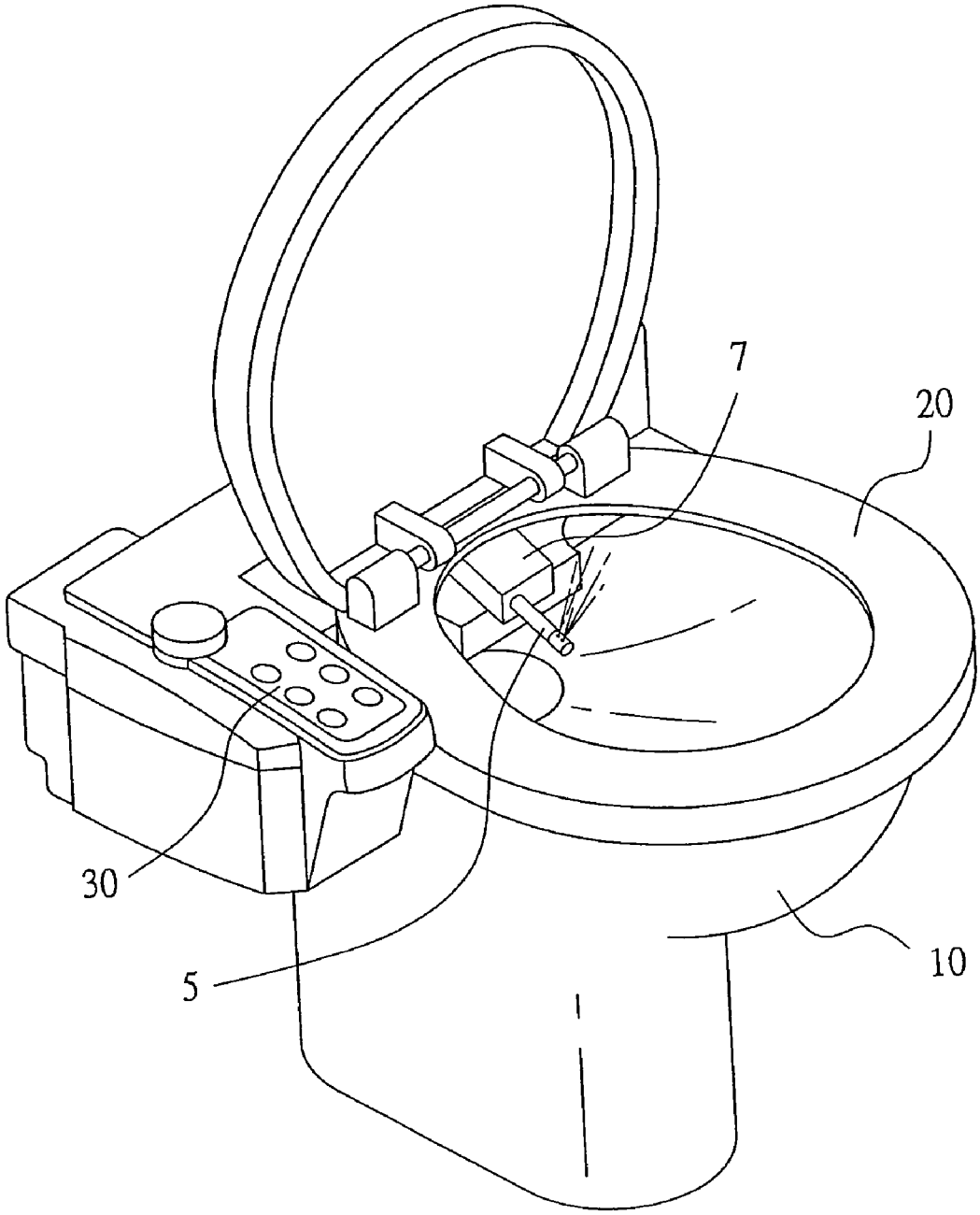
FIG. 10 is a perspective view of the lavatory jet assembly incorporated in a lavatory according to the above second embodiment of the present invention.

Referring to FIG. 10 of the drawings, an external periphery of the lavatory jet assembly according to this embodiment of the present invention is capable of being incorporated with a concealing member 7, wherein the concealing member 7 is installed in between the rear portion of the lavatory the lavatory seat 20, such that the jet unit 5 is extended downwardly at a predetermined angle, so as to clean the user's excretion organ area automatically, after the user has urinated or defecated.

Figure 8:
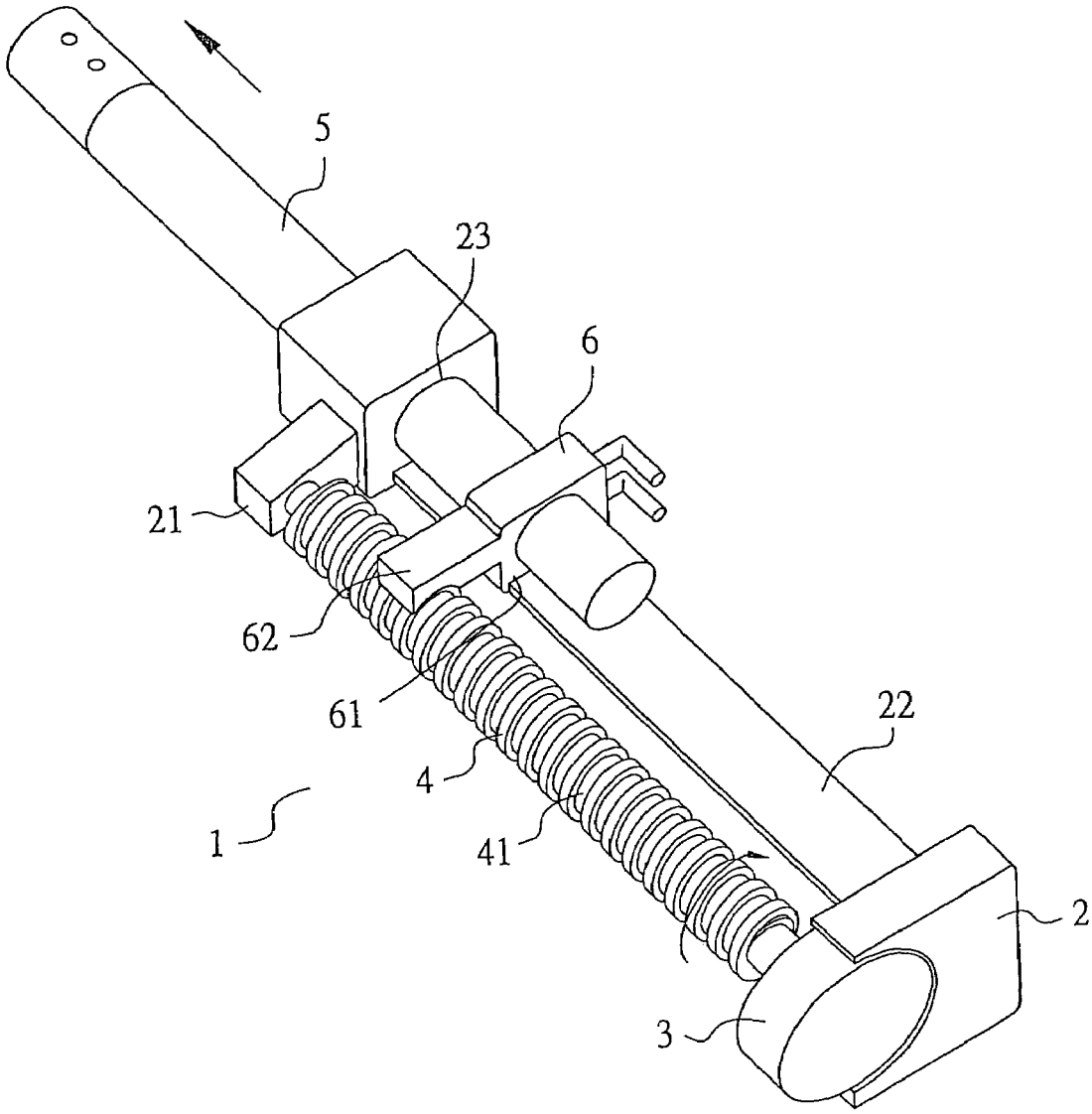
FIG. 8 is another perspective view of the lavatory jet assembly according to the above second embodiment of the present invention.

Referring to FIG. 8 and FIG. 9 of the drawings, the user can choose the spraying time of the jet unit 5 through a control stand 30 located at a side of the lavatory 10. And, by pressing on to the buttons by hand, the user can also control the protruding length of the jet unit 5, so as to drive the rotation of the motor 3, such that the rotational movement of the motor 3 drives the rotation of the driving shaft 4, so as to guide the water inlet 6, which is in touch with the spiral groove 41, such that the protruding portion 63 moves towards a predetermined direction, which would simultaneously move the jet unit 5, which is in connection with the water inlet 6, so as to provide cleaning by spraying water to different users.

According to the preferred embodiment of the present invention, the motor in both embodiments can be a servo motor or a stepping motor.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lavatory jet assembly for a lavatory having an upper rim and defining a top opening therewithin, comprising:

a mounting base, which is adapted for securely mounting to said lavatory, having an inner end positioning closed to said upper rim of said lavatory and an outer end extended towards a center of said top opening;

a jet unit comprising a water inlet for guiding a predetermined volume of water flowing from said lavatory, and a jet nozzle communicatively connecting to said water inlet for upwardly ejecting said water therefrom towards said top opening of said lavatory, said water inlet is an elongated water guider having one end defining said water inlet and opposed end connecting to said jet nozzle;

a jet adjusting arrangement comprises a power unit supported by said mounting base and an adjustment slider powered by said power unit to adjustably move said jet nozzle along said mounting base between said inner and outer ends thereof such that said jet nozzle is selectively moved to a desired cleaning position for ejecting said water within said upper rim of said lavatory, wherein said adjustment slider comprises a belt gear system comprises a main belt gear connected to said axle of said power unit, a driven belt gear connected to said outer end of said base, and a transmission belt provided for tying around said main belt gear and said driven belt gear, wherein said water guider is connected to said transmission belt, such that when said power unit is switched on, said power unit rotates said main belt gear, driving said transmission belt such that said water guider is moved along with said transmission belt, such that said jet unit is slid along said mounting base to adjust cleaning position of said jet nozzle;

a center axel having a first end connecting to a protruding board that attached to a coupling stand of said mounting base, and an opposite second end connecting to said driven belt gear, wherein said mounting base further has a first contacting portion extended toward said transmission belt in a direction opposite to said water inlet, a second contacting portion extends from said center axel toward said first contacting portion and a resilient element disposed between said first contacting portion and said second contacting portion, said resilient element exerting a biasing force to move apart said first and said second contacting portions so as to automatically maintain the predetermined amount of tension of said belt gear system.

2. The lavatory jet assembly, as recited in claim 1, wherein said power unit comprises a motor having an axle, and a power source, wherein said motor is communicatively connected to said inner end of said mounting base, and electrically connected to said power source.

3. The lavatory jet assembly, as recited in claim 1, further comprising an elongated water guider having one end defining said water inlet and an opposed end connected to said jet nozzle, wherein said water guider is mounted to said adjustment slider to parellelly slide along said mounting base to adjust cleaning position of said jet nozzle.

4. The lavatory jet assembly, as recited in claim 2, further comprising an elongated water guider having one end defining said water inlet and an opposed end connected to said jet nozzle, wherein said water guider is mounted to said adjustment slider to parellelly slide along said mounting base to adjust cleaning position of said jet nozzle.

5. The lavatory jet assembly, as recited in claim 1, wherein said coupling stand having a coupling portion mounted to said transmission belt, and a driving portion substantially mounted to said water guider at a position closed to said water inlet such that when said coupling portion of said coupling stand is driving along said transmission belt when said motor rotates, such that said driving portion of said coupling stand substantially pushes said water guider to slid along said mounting base so as to adjust said cleaning position of said jet nozzle of said jet unit.

6. The lavatory jet assembly, as recited in claim 3, wherein said coupling stand having a coupling portion mounted to said transmission belt, and a driving portion substantially mounted to said water guider at a position closed to said water inlet such that when said coupling portion of said coupling stand is driving along said transmission belt when said motor rotates, such that said driving portion of said coupling stand substantially pushes said water guider to slid along said mounting base so as to adjust said cleaning position of said jet nozzle of said jet unit.

7. The lavatory jet assembly, as recited in claim 4, wherein said coupling stand having a coupling portion mounted to said transmission belt, and a driving portion substantially mounted to said water guider at a position closed to said water inlet such that when said coupling portion of said coupling stand is driving along said transmission belt when said motor rotates, such that said driving portion of said coupling stand substantially pushes said water guider to slid along said mounting base so as to adjust said cleaning position of said jet nozzle of said jet unit.

8. The lavatory jet assembly, as recited in claim 6, further comprising a control panel electrically connected to said power source and said motor, so as to control a movement of said jet nozzle to said desired cleaning position.

9. The lavatory jet assembly, as recited in claim 7, further comprising a control panel electrically connected to said power source and said motor, so as to control a movement of said jet nozzle to said desired cleaning position.

10. The lavatory jet assembly, as recited in claim 8, wherein said motor is a servo motor.

11. The lavatory jet assembly, as recited in claim 9, wherein said motor is a servo motor.

12. The lavatory jet assembly, as recited in claim 8, wherein said motor is a stepping motor.

13. The lavatory jet assembly, as recited in claim 9, wherein said motor is a stepping motor.

* * * * *